United States Patent [19]

Van Der Hoeven

[11] Patent Number: 5,005,832

[45] Date of Patent: Apr. 9, 1991

[54] PORTABLE ABDOMINAL EXERCISER

[76] Inventor: Martin A. Van Der Hoeven, 2726 Loker Avenue W., Carlsbad, Calif. 92008

[21] Appl. No.: 395,537

[22] Filed: Aug. 18, 1989

[51] Int. Cl.[5] ..... A63B 21/02

[52] U.S. Cl. ..... 272/137; 272/135

[58] Field of Search ..... 272/99, 135, 136, 137, 272/138, 139, 140, 141, 142, 143

[56] References Cited

U.S. PATENT DOCUMENTS

| | | | |
|---|---|---|---|
| 3,491,751 | 1/1970 | Wolfing | 272/99 X |
| 3,503,388 | 3/1970 | Cook | 272/99 X |
| 4,428,577 | 1/1984 | Weingardt | 272/135 |
| 4,775,150 | 10/1988 | Graham | 272/143 |
| 4,863,159 | 9/1989 | Brown, Jr. | 272/137 X |

*Primary Examiner*—Robert Bahr

*Attorney, Agent, or Firm*—Henri J. A. Charmasson

[57] ABSTRACT

An exercise device for specific isolation and development of abdominal muscle groups comprises a deformable spring-resistance which is closely retained against the user's abdominal region and provision for tensioning the spring device with a dual-handle pulley system and an adjustable means for accurately controlling the spring tension and the resistance force that is pressed against the abdomen. When the device is in place and tensioned the user resists the tension by expanding the abdomen to exercise and thus develop the abdominal musculature.

10 Claims, 1 Drawing Sheet

PORTABLE ABDOMINAL EXERCISER

FIELD OF THE INVENTION

This invention is a resistance-based exercise device for beneficial workout and development of specific muscle groups, namely of the abdominal musculature consisting of upper, lower and transverse abdominal muscles. More particularly, the invention relates to small, inexpensive, portable exercisers adapted to exercise specific muscle groups.

BACKGROUND OF THE INVENTION

In the world of fitness, exercise and body-building, the efficient development of abdominal muscles of the human body is particularly difficult. Because the abdominal muscles are not attached to any joint, traditional joint movement exercises have no effect on the abdominals. Exercises such as sit-ups or weight-loaded variations on sit-ups may indirectly involve the abdominal muscles but are inefficient because much of the exercise energy is dissipated in the joints and muscles attached to the joints such as hip flexors. Thus the traditional exercises and machines designed to exercise abdominal muscles are inefficient at best and require long and laborious programs of rigorous exercise.

There is a need for more efficient manners and devices for exercise and development of abdominal musculature in addition to sporting and personal appearance aspects, in that the medical consequences of weak abdominal muscles are dangerously weak back and spinal erector muscle groups which oppose the frontal abdominal groups. Proper and efficient exercise of the abdominal muscles will tend to require strengthening of back musculature, having both remedial and preventive beneficial effects relating to common lower back and spinal problems.

The present inventor has been involved in development of various approaches to this single problem, that is efficient development of abdominal musculature, and has developed devices which have been the subject of prior applications for Letters Patent, for instance Ser. No. 156,404 filed Feb. 16, 1988 for Abdominal Musculature Development Method and Device. That application described a large floor-mounted machine intended for gymnasiums and medical facility usage which employed a novel method of tensioning the abdominal muscles for efficient exercise by maintaining a specifically controlled posture during a weighted movement. Despite this inventor's previous developments, more remains to be done in that the previous device, while a significant advance over the prior art, left unanswered the need for a simplified, inexpensive device and method for exercising where larger machines might not be available.

Because the previous method developed by this inventor is oriented to controlled posture and tensioning with large weight-type devices, that device could not be adapted to a portable use. In order to be made convenient, portable and accessible to a large market share, a new and more compact method was sought which might approach the efficiency of the larger machine and retain many of the benefits newly developed for abdominal musculature exercise.

Thus it is an object of the present invention to enable exercise of the abdominal musculature in an efficient and effective way.

It is a further object of the invention to provide a means of exercising the abdominal musculature that will isolate a major portion of the required user effort on the abdominal muscles being exercised, minimizing wasted motion.

A further object of the invention is to provide a device that is easily portable and usable in nearly any environment.

Another object of the invention is to provide a portable device that will correctively address lower back problems at the same time as exercising the abdominal musculature.

Another object of the invention is to provide a portable device that can be adjustable over a wide range for a variety of users and their particular physical condition.

A final objective of the invention is to provide a simplified exercise method for development of the abdominal musculature that involves a minimum of separate parts and can be easily assembled and used by an unsophisticated purchaser.

SUMMARY OF THE INVENTION

These an other objectives of the invention are accomplished by providing a device consisting primarily of a resilient spring-band of metal or deformable plastic configured so that the center of the leaf-spring shape is placed directly on the abdominal muscles to provide variable resistance exercise against those muscles. The spring-band is held in place by a leather or elastic strap connected at two points of the band and encircling the user's waist. As an option, cushions or inflatable air-bladders can be placed at the back of the retaining waistband to position the device and add useful pressure to the lower back and spinal erector musculature. The spring-band can be deformed and pressed against the abdominal musculature by means of pulling on two pulley-handles affixed to the outer portions of the spring-band. The deformation and resistance of the spring-band is controlled by an adjustable device such as a hydraulic or air cylinder spanning a portion of the curvature of the spring-band. When the user puts the device in place and pulls on the pulley-handles the spring-band is pressed tightly against the abdominal muscles and the user holds the position with his arms, takes a deep breath and holds it, and expands his abdominal musculature against the pressure of the spring-band for a defined time period and then relaxes. The exercise is then repeated in sets as is common with development exercises of various kinds.

DESCRIPTION OF THE PREFERRED EMBODIMENT OF THE INVENTION

Figure 1:
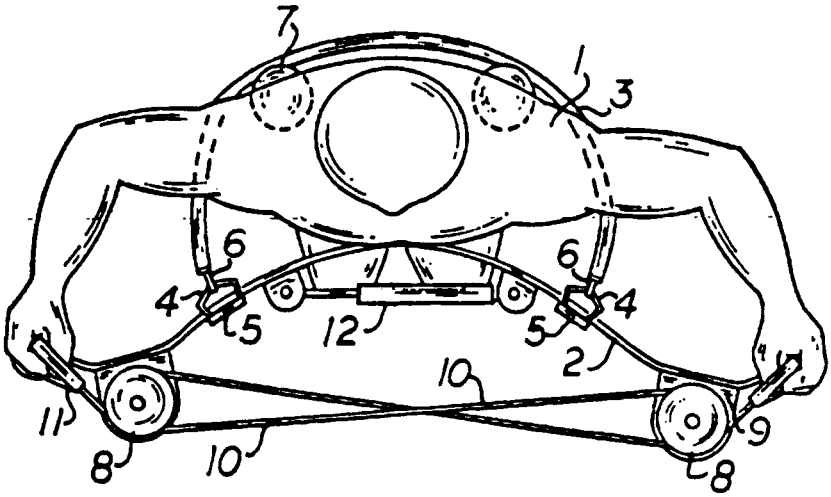
FIG. 1 is a top view of a human user of the exercise device showing the device in use and in place on the user's body.

Turning to FIG. 1 it can be seen from a top view of a user with the device in place that the device consists principally of a leaf-spring band 2 fashioned of resilient metal or plastic and formed in a sufficient bow-shape to provide resistance to radial pressure during the exercise The device is positioned and held in place on the user's body by waistband 3 of leather of elastic material which is coupled to retaining ring 4 held in place on the spring-band 2 by retaining pin 5 and releasably connected by snap-hook 6. Lumbar pad 7 consisting of either a padded surface of the waistband or an inflatable air-bladder are held in place by the belt against the user's lower back region to provide posture control and useful resistance pressure against the spinal erector muscles during exercise. The leaf-spring 2 is pressed directly against the user's abdomen in order to exercise the musculature in the following manner. A pulley-wheel 8 is affixed to the outer ends of the leaf-spring band by brackets 9 in a horizontal plane and a non-elastic line 10 attached to each of the pulley-wheels and terminating in hand-grip 11. Each of the nonelastic lines is threaded from the handle-grip around the outer circumference of the near pulley-wheel to the opposite pulley-wheel around the inner circumference and attached to the hub of the pulley. The objective of the pulley is not particularly to provide leverage but to provide smooth functioning of the short travel of the tensioning lines during the exercise and to keep the lines in place.

In operation the user will grasp the handles 11 in a pronated or thumb up position and pull against the structure and tension of the leaf-spring, in turn pressing the leaf-spring device against the abdomen while the forces on the pulleys will tend to draw together the ends of the leaf-spring, the inward deformation is controlled and limited by a restraining device 12 here consisting of a liquid or gas filled cylinder which is placed within the concave side of the leaf-spring and attached to piston side bracket 13 and cylinder side bracket 14. As will be seen later, the piston will also have effect on the resistance force during exercise against the abdominal muscles, but here serves, not only to limit deformation of the leaf-spring, but to enable use of light-weight flexible and inexpensive materials for the leaf-spring itself because the leaf-spring is not required to possess the degree of rigidity or stiffness to resist the exercise forces if it were not assisted by the reinforcing device of the cylinder. Of course, other reinforcing devices of various materials, functions or springs could also be devised for this purpose without changing the effect of the device or the exercise.

Having tensioned the pulleys and leaf-spring against the abdomen, the user is required to take a deep breath and hold it and further to force his diaphragm downward and thus the abdominal muscles outward against the leaf-spring in as forceful a fashion as he can manage. When the user reaches a position of maximum effort through the diaphragm and abdominal muscles and can maintain that effort and position for a period of seconds, pressure is placed against the center convex section of the leaf-spring forcing and actually moving the leaf-spring outward as the abdominal muscles overcome the pressure placed against it. This force will tend to flatten the leaf-spring as exercise movement of the abdominal muscles is achieved. As the center of the spring moves outward so also will the ends of the leaf-spring tend to flatten out and separate tensioning the pulley lines and drawing the grip-handles inward, increasing the tension against the user's arms. This tension adds to the effect of the abdominal exercise by transmitting the tension through the arms, biceps, shoulders and latissimus dorsi muscles down the sides of the user's body where further indirect exercise pressure can be transmitted to the abdominals.

Since the pressure of the extension of the abdominal muscles against the center portion of the leaf-spring bar pushes the leaf-spring bar outwardly, the leaf-spring would thus tend to flatten, forcing the ends apart and unless further tension through the handle-grips is provided, the ends of the bar will tend to separate and to separate relative to each other and the hand-grips be drawn in. While this motion may be desirable to gage progress of the exercise or to indicate to the user that his effort should be increased, the progress of the movement of the bar must also be restrained within limits to maintain pressure on the abdominals and effectiveness of the exercise. Thus the restraining cylinder 12 which spans the concave-shape of the spring bar and is retained at fixation points 13 and 14 on the spring bar will maintain the tension by restraining flexion of the bar. The exercise can be quite closely controlled, in fact, by providing an adjustment means which could easily be incorporated, for instance, into an air-type piston and cylinder arrangement to vary the restraining strength of the cylinder between certain maximum and minimum forces. With such adjustment the device can accommodate progressive strengthening of the user and as the user advances in strength and development the tension of the device can be increased.

Thus the opposing forces intentions require varying and increasing effort through the abdominal muscles providing a highly concentrated and isolated effect against the abdominals, and thus producing an efficient exercise cycle.

Figure 2:
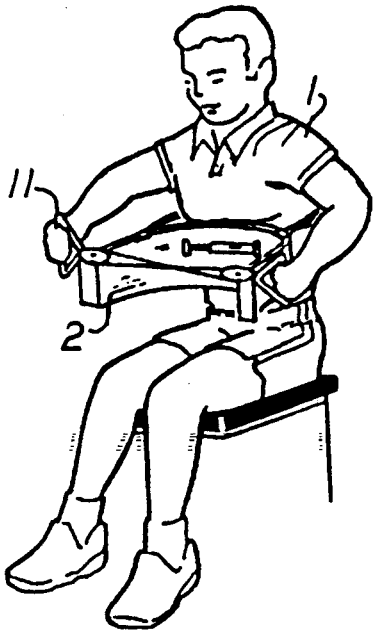
FIG. 2 is a perspective frontal view of the exercise device in use.

The user's posture and positioning and utilization of the portable abdominal exercise device is further illustrated in FIG. 2, a perspective view showing the user 1 in seated position. The leaf-spring component 2 is once again placed against the user's abdomen and tensioned by pulling on grip-handles 11 forcing the center of the spring inward against the abdomen and providing a center of resistance which the user will oppose by expansion of the abdominal muscles. In this posture the user can progressively exercise the specific muscle group for a period of some seconds, repeating the exercise several times for an efficient work-out that a typical user will find is maximized in only a few minutes. It can also be seen in this view that the width at the center portion of the leaf-spring component is dimensioned to fit to the user's abdominal region, an be generally broad enough to provide resistance surface for the majority of the abdominal musculature. While the device is illustrated in a standard configuration and dimension, it could of course, be made in differing widths according to its application to specific muscle groups or according to body dimensions of users. Within these ranges it has been found that about three inches would be the minimum width of the band and about sixteen inches would be an upper limit of the width of the band.

As the exercise device is used daily, the user will enjoy increased strength and definition of the abdominal muscles and will be able to operate the exercise device for longer intervals and increased multiples of the exercise in sets. Because the exercise device is compact, light-weight, easy to use and portable, the user is encouraged to make regular use of the exercise device and realize the benefits in muscle tone and growth as well as benefit to surrounding and balancing muscle groups such as lumbar and spinal erectors. As the device will have a variety of therapeutic uses, its ease of use and lack of need for intensive instruction of supervision will make it adaptable to use by semi-invalids, patients recovering from various injuries, and even persons suffering from limitations of strength and movement such as arthritis. It can also be seen that the device avoids the necessity of any structure or required effort below the waist and thus can be used without problems by persons confined to wheelchairs.

While the invention disclosed herein has been described by means of a specific embodiment and one application thereof, there are numerous modification and variations thereof which could be made by those skilled in the art. It is therefore to be understood that within the scope of the appended claims, the invention may be practiced otherwise than specifically described herein.

What is claimed is:

1. An portable exercise device comprising:
an elongate and generally arcuate shaped bar;
the width of said bar at its center being shaped and dimensioned to fit and press against a user's abdomen;
the length of said bar being approximately the shoulder width of the user;
handgrip means attached near both ends of the bar in such position as to enable the user to press the convex side of the arcuate bar against his abdomen;
a tensioning means spanning the concave side of the arcuate bar and horizontally disposed across the center point of the bar; and
said tensioning means being attached to the bar on both sides of the enter point to restrain flexion of the bar.

2. The device of claim 1 further comprising:
adjustment means associated with said tensioning means whereby the force required to flex the bar may be varied.

3. An portable exercise device comprising:
an elongate and generally arcuate shaped bar;
the width of said bar at its center being shaped and dimensioned to fit and press against a user's abdomen;
the length of said bar being approximately the shoulder width of the user;
handgrip means attached near both ends of the bar in such position as to enable the user to press the convex side of the arcuate bar against his abdomen;
means for closely holding the bar on the user's body during exercise;
said means for holding comprising:
a belt,
attachment means for each end of the belt, mating attachment means on the concave side of the arcuate bar for affixation of the attachment means at each end of the belt; and
said belt being dimensioned to closely fit around the lumbar region of the user.

4. The device of claim 3 wherein the belt consists of elastic material belt.

5. The device of claim 4 further comprising:
padding disposed on the wearer-side surface of said belt in such position to fit against the wearer's lumbar musculature.

6. The device of claim 5 further comprising:
(a) pulleys mounted near each end of said bar in generally horizontal orientation;
(b) line disposed around said pulleys; and
(c) said handgrips being attached to the line near both the right and left pulleys, such that as the handgrips are pulled in opposing horizontal directions by the user, the ends of the bar are tensioned toward each other.

7. The device of claim 5, wherein said padding consists of fluid-fillable bladders.

8. The device of claim 7, wherein said line is in two parts, each part being attached at one end to one of said handles, passing through at least one of said pulleys, and being attached at its other end to a point on said bar.

9. A portable exercise device comprising:
(a) an elongate and generally arcuate-shaped bar, said bar consisting of resilient material;
(b) the width of said bar is at its center being shaped and dimensioned to fit and press against a user's abdomen;
(c) the length of said bar being approximately the shoulder width of the user;
(d) a restraining belt releasably attached to the concave side of the arcuate bar to closely fit around the lumbar region of the user;
(e) pulleys mounted near each end of said bar and generally horizontal orientation;
(f) line disposed around said pulleys; and
(g) hand-grips being attached to the line near both right and left pulleys such that as the hand-grips are pulled in opposing horizontal directions by the user the ends of the bar are tensioned toward each other.

10. The device of claim 9 further comprising a hydraulic cylinder spanning the concave side of the arcuate bar and horizontally disposed across the center point of the bar, said cylinder being attached to the bar on both sides of the center point to restrain flexion of the bar.

* * * * *